United States Patent [19]

Kawae et al.

[11] 4,363,701

[45] Dec. 14, 1982

[54] SUPPORTING MEMBER FOR PAPER-MAKING SCREEN IN PAPER MACHINES

[75] Inventors: Yasunobu Kawae; Michio Kakimura, both of Kokubu, Japan

[73] Assignee: Kyoto Ceramic Kabushiki Kaisha, Japan

[21] Appl. No.: 254,732

[22] Filed: Apr. 16, 1981

Related U.S. Application Data

[63] Continuation-in-part of Ser. No. 228,808, Jan. 28, 1981, abandoned, which is a continuation of Ser. No. 102,127, Dec. 10, 1979, abandoned.

[51] Int. Cl.[3] ..... D21F 1/00

[52] U.S. Cl. ..... 162/301; 162/352; 162/374

[58] Field of Search ..... 162/352, 354, 374, 301; 501/97

[56] References Cited

U.S. PATENT DOCUMENTS

Re. 29,417 9/1977 Lee et al. ..... 162/374

*Primary Examiner*—Peter Chin

*Attorney, Agent, or Firm*—Spensley, Horn, Jubas & Lubitz

[57] ABSTRACT

A supporting member of the papermaking screen in paper machines is disclosed, which is made with a sintered body consisting essentially of silicon nitride, having a porosity of less than about 0.8% whereby the abrasion loss rate of the papermaking screen is able to be remarkably reduced as compared with the conventional supporting members made of alumina ceramic, as a result of which the useful life of the papermaking screen can be lengthened greatly.

10 Claims, 7 Drawing Figures

SUPPORTING MEMBER FOR PAPER-MAKING SCREEN IN PAPER MACHINES

This is a continuation-in-part of copending U.S. Ser. No. 228,808, filed Jan. 28, 1981, abandoned which is a continuation of U.S. Ser. No. 102,127, filed Dec. 10, 1979, now abandoned.

BACKGROUND OF THE INVENTION

1. Field of the Invention

This invention relates to a supporting member for the papermaking screen in paper machines, and more particularly, to a member for contiguously supporting the papermaking screen which is running continuously, said member being designed to lessen the abrasion of the screen by being made of a sintered body consisting mainly of silicon nitride of porosity less than about 0.8%.

2. Prior Art

FIGS. 1(*a*) and (*b*) show schematic drawings of prior art paper machines to which the member according to the present invention has been applied, and FIG. 2 shows a longitudinal sectional view giving an example of where the member according to the invention is applied to the forming board.

We will here describe the outline of the prior art paper machines, and at the same time point out their deficiencies, with reference to these figures.

Of the different paper machines which utilize the member according to the present invention with the object of supporting the papermaking screen, the one with a long screen type as shown in FIG. 1(*a*) is so designed that the paper material, namely, slurry consisting of paper pulp and water is supplied from a head box 11 onto the screen (principally made of metal) 12 which is being driven by rollers 18, 19 in the direction of the arrow shown in the figure, and the watery paper pulp 13 is dehydrated progressively with the aid of the running of the screen 12 and the tractive force of rollers 22, 23 which are positioned just under the screen 12, then being followed by the treatment of rolling, drying, and so on.

For the purposes of partly aiding the dehydration of the pulp and partly supporting the screen 12, the construction of the paper machine of such a type is bolstered by a forming board 14, a deflector 15, a foil 16, and a suction box 17, which all are arranged contiguously just under the screen 12 in succession, and further by being provided with tension rollers 20, 21.

In addition to this type, there is also used another kind of paper machine, that is, a twin wire type such as is shown in FIG. 1(*b*). This type is so designed that the two screens 12, 12' are driven by a driving roller 18 and tension rollers 20, 21, while paper pulp 13, after having been supplied from the head box 11 which is set up above, is compressed from both sides between the two screens 12, 12' which are supported by the supporting members 24. The pulp is dehydrated by the suction box 17, and then the resulting dehydrate is treated by rolling and drying.

In these paper machines, there are provided supporting structures such as the forming board 14, the foil 16 and others which are used, for example, as in the one shown in FIG. 1(*a*), for the purpose of contiguously supporting the screen 12. As part of these structures, such as the forming board 14, as shown in FIG. 2, a plurality of supporting members 14' are arranged to extend transversely to the running direction of the screen 12. In such supporting members, there has been widely used heretofore a ceramic material obtained from a sintered body of alumina or silicon carbide or others, producing somewhat satisfactory results. But with these conventional members there has resulted a large degree of abrasion of the screen 12 running incessantly over the supporting members 14', though the wear rate depended on the property of paper pulp.

On the other hand, in the latest paper machines higher running speeds have been used. Therefore, with the use of an apparatus which comprises a conventional forming board, deflector, table roll, and suction box, the required dehydration cannot take place to the fullest extent, resulting in the deterioration of quality of the paper produced.

As a countermeasure, there is now being used a foil in the capacity of a means for both supporting the screen and dehydrating. However, using prior art materials which are quite porous, this means will be eroded due to abrasion. Thus the efficiency of dehydration drops, which effects a bad influene on the quality of paper. This also occurs with the supporting member being provided on the suction dehydrator, such as a suction box. In addition, the supporting members heretofore in use, such as are made of alumina ceramic, silicon or the like, can also detrimentally abrade the screen itself to a great degree.

SUMMARY OF THE INVENTION

It is therefore an object of this invention to provide supporting members for the papermaking screens in paper machines which are made of a material which will reduce the abrasion loss of such screens.

This object is achieved by making the supporting members of a sintered body consisting essentially of silicon nitride having a porosity of approximately 0.8 percent or less. It has been discovered that, by using a material with such a low porosity, the abrasion rate of all types of screens currently being used, bronze, chrome-copper alloy, and plastics may be significantly reduced. The optimum effects of the low porosity generally obtain for all these materials up to a level of about 0.8 percent porosity.

The novel features which are believed to be characteristic of the invention, both as to its composition and method of operation, together with further objectives and advantages thereof, will be better understood from the following description considered in connection with the accompanying drawings in which a presently preferred embodiment is illustrated by way of example. It is to be expressly understood, however, that the drawings are for the purpose of illustration and description only, and are not intended as a definition of the limits of the invention.

DETAILED DESCRIPTION OF THE PREFERRED EMBODIMENT

On the grounds that a sintered body consisting essentially of silicon nitride has a number of characteristics such as a great high-temperature strength and excellent heat shock resistance, abrasion resistance, and so on, it has been widely used heretofore in some special fields in the capacity of heat resisting material. However, silicon nitride itself, which is a sintering substance having a strong covalent bond, is difficult to densely sinter by the use of the substance alone, unlike alumina ceramic. Thus, it becomes important to employ some sintering assistant. The composition of silicon nitride used as an example in accordance with the present invention is as follows:

$Si_3N_4$=74.0%
FeSi=6.0%
Fe=1.5%
$Fe_2O_3$=11.5%

To such a compound of silicon nitride is added some metal oxide as a sintering assistant, such as, for example, MgO to make sintering material. Further, after adding to this material an adequate quantity of binders of various kinds as are well known in the art and then molding it into a desired shape, it is sintered in the range of 1400 and 1700 degrees C. in an atmosphere of $N_2$ gas. The resulting sintered body is in a state where, except for its main phase alpha-$Si_3N_4$, unreactive ferrosilicon and metal oxide having been produced in the process of sintering have remained in the form of crystal or non-crystalloid. The properties of both the sintered body of silicon nitride thus obtained and alumina ceramic heretofore used as the supporting member of the screen are listed in contrast to the following Table 1.

TABLE 1

| item | material: sintered body of silicon nitride | material: alumina-ceramic |
|---|---|---|
| appearance | dense | dense |
| coloration | dark gray | white |
| bulk specific gravity | 3.3 | 3.8 |
| porosity % | 0.3 | 0 |
| bending strength kg/mm$^2$ | 25 | 31 |
| Rockwell hardness HRA | 87 | 87 |
| Young's modulus ($\times 10^6$ kg/cm$^2$) | — | 3.5 |
| linear expansion coefficient (X − 6)/°C. | 3.5 | 7.7 |

Figure 3:
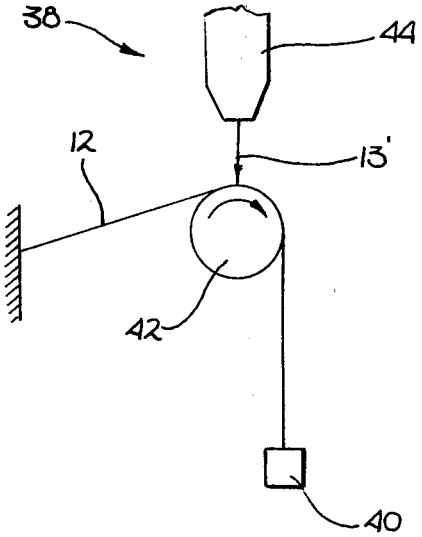
FIG. 3 is a schematic illustration of an abrasion tester by which performances both of the member according to the present invention and of the prior art are tested.
Figure 4:
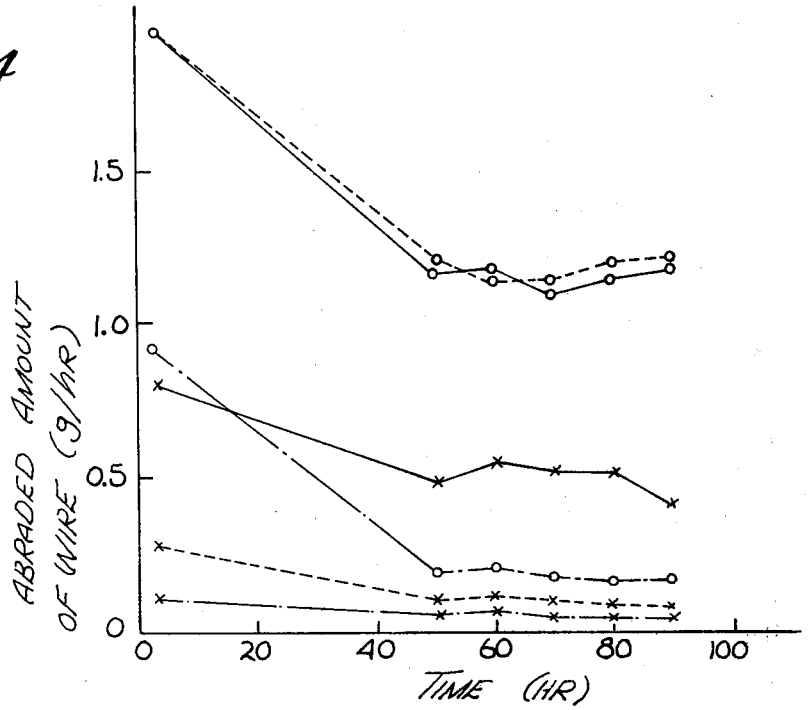
FIG. 4 is a graphical representation showing the correlation between the abraded amount of the screen obtained by the same tester as in FIG. 3 and the types of materials of supporting members.
Figure 5:
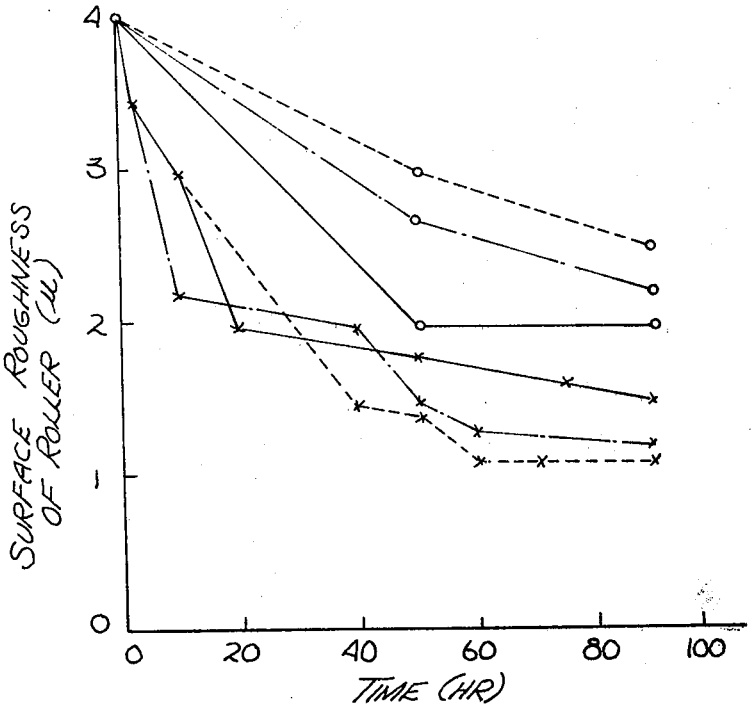
FIG. 5 is a graphical representation showing the correlation between the surface roughness and the test time, regarding each of the screens tested.

A number of experimental and operative examples conducted with the use of such a sintered body of silicon nitride as prepared above will now be more particularly described with reference to the accompanying drawings: FIG. 3 is a schematic illustration of an abrasion tester of the screen in order to measure the performance of the screen supporting member according to the present invention; FIG. 4 is a graphical representation showing the correlation between the abraded amount of the screen as measured by the abrasion tester and the supporting members being made of different materials each time; and FIG. 5 is a graphical representation showing the correlation between the surface roughness and the test time for each different screen material.

The abrasion tester 38 in question is as shown schematically in FIG. 3, wherein the paper-making screen 12, which has at its free end a constant weight 40 and has the other end fastened fixedly, is suspended on the roller 42 made of the same type of material as the supporting member of the screen, and wherein the nozzle 44 allowing model pulp materials 13' to fall on the screen is disposed directly above the aforesaid roller 42. The roller 42 is made to continuously rotate in the direction of the arrow while letting the pulp materials 13' come down on the screen. The tester is thus able to measure the abraded condition of the screen 12 which is in contact with the surface of the above roller 42. The conditions of the abrasion test conducted simulating the running of the screen 12 over the supporting members in paper machines are as follows:

(a) rotational frequency of roller: 1500 rpm
(b) circumferential speed thereof: 283 m/min
(c) concentration of raw material: 2 tulk %
(d) delivery rate of material: 0.6 l/min
(e) tension of screen: 2.5 kg/cm
(f) width of screen: 40 mm
(g) sort of screen:
  (g-1) bronze: 60-mesh
  (g-2) chrome plated copper alloy: 65-mesh
  (g-3) plastic: 60-mesh
(h) material of roller:
  (h-1) alumina ceramic
  (h-2) sintered body consisting essentially of silicon nitride
(i) shape of roller: $60\phi \times 60$ long (mm)
(j) surface roughness of roller: $R_{max}=4^S$ (both alumina ceramic and sintered body consisting essentially of $Si_3N_4$)
(k) abraded amount of screen: This is determined by calculating the loss in weight of the screen per unit time before and after the test.

The test results obtained under the foregoing conditions will be given in FIG. 4. Incidentally, the lines given in both FIGS. 4 and 5 indicate the particular materials of rollers and screens as are shown in the following Table 2.

TABLE 2

| material of screen | material of roller: alumina ceramic | material of roller: sintered body of silicon nitride |
|---|---|---|
| bronze | -O- | -X- |
| plastic | ---O--- | ---X--- |
| chrome plated copper alloy | -.-O-.- | -.-X-.- |

As is clearly understood from FIG. 4, viewing the different materials of the screens, first the bronze screen and then the chrome plated copper alloy one are arranged in order of the magnitude of the abraded amount. In either case, when the material of the roller 42 is alumina ceramic, the abraded amount of the screen is great, while on the contrary when a sintered body essentially of silicon nitride is used as the material of the roller 42, the abraded amount is proven to be smaller. This indicates that the degree of the abrasion of the running screen is smaller when using the supporting member made of the sintered body essentially of silicon nitride, and thus it is more advantageous as compared with conventional supporting members formed with alumina ceramic.

The next Table 3 presents the results obtained from the investigation as to what differences result from a difference in the porosity of the sintered body of silicon nitride on the above-mentioned abraded amount.

TABLE 3

| | kind of sample | | | | | |
|---|---|---|---|---|---|---|
| | our invention | | | comparison example | | prior art |
| | sample ideogram | | | | | |
| item | A' | A | A'' | C' | C'' | B |
| bulk specific gravity | 3.4 | 3.3 | 2.9 | 2.9 | 2.7 | 3.8 |
| bending strength ($kg/mm^2$) | 30 | 25 | 37 | 35 | 25 | 31 |
| Rockwell hardness | 87 | 87 | 87 | 84 | 82 | 87 |
| Young's modulus ($\times 10^6$ $kg/cm^2$) | 2.5 | 2.5 | 2.5 | 2.3 | 2.3 | 3.5 |
| linear expansion coefficient ($\times 10^{-6}$/C) | 3.7 | 3.5 | 2.6 | 2.4 | 3.0 | 7.7 |
| porosity (%) | 0.05 | 0.3 | 0.8 | 2.0 | 1.1 | 0 |
| Adraded amount of wire (%/hr) | | | | | | |
| type of wire | | | | | | |
| bronze | 0.5 | 0.75 | 0.85 | 0.95 | 1.46 | 1.2 |
| chrome copper alloy | 0.03 | 0.10 | 0.15 | 0.20 | 0.50 | 0.25 |
| plastic | 0.1 | 0.2 | 0.4 | 0.70 | 2.48 | 1.0 |

Note:
The composition of silicon nitride in examples A', A'' and A''' is the same as the before-mentioned (referred to as A), only the porosity is significantly varied, as listed in the table. Examples C' and C'' are presented to show the effects of greater porosity and have the same composition as example A. Examples C' and C'' were produced by a reaction bond sintering method as is known in the art. Sample B is the prior art alumina ceramic.

From this table, it has been observed that the abraded amount becomes less as the porosity is decreased. More specifically, the optimum results are achieved when the porosity is about 0.8% or less.

Figure 6:
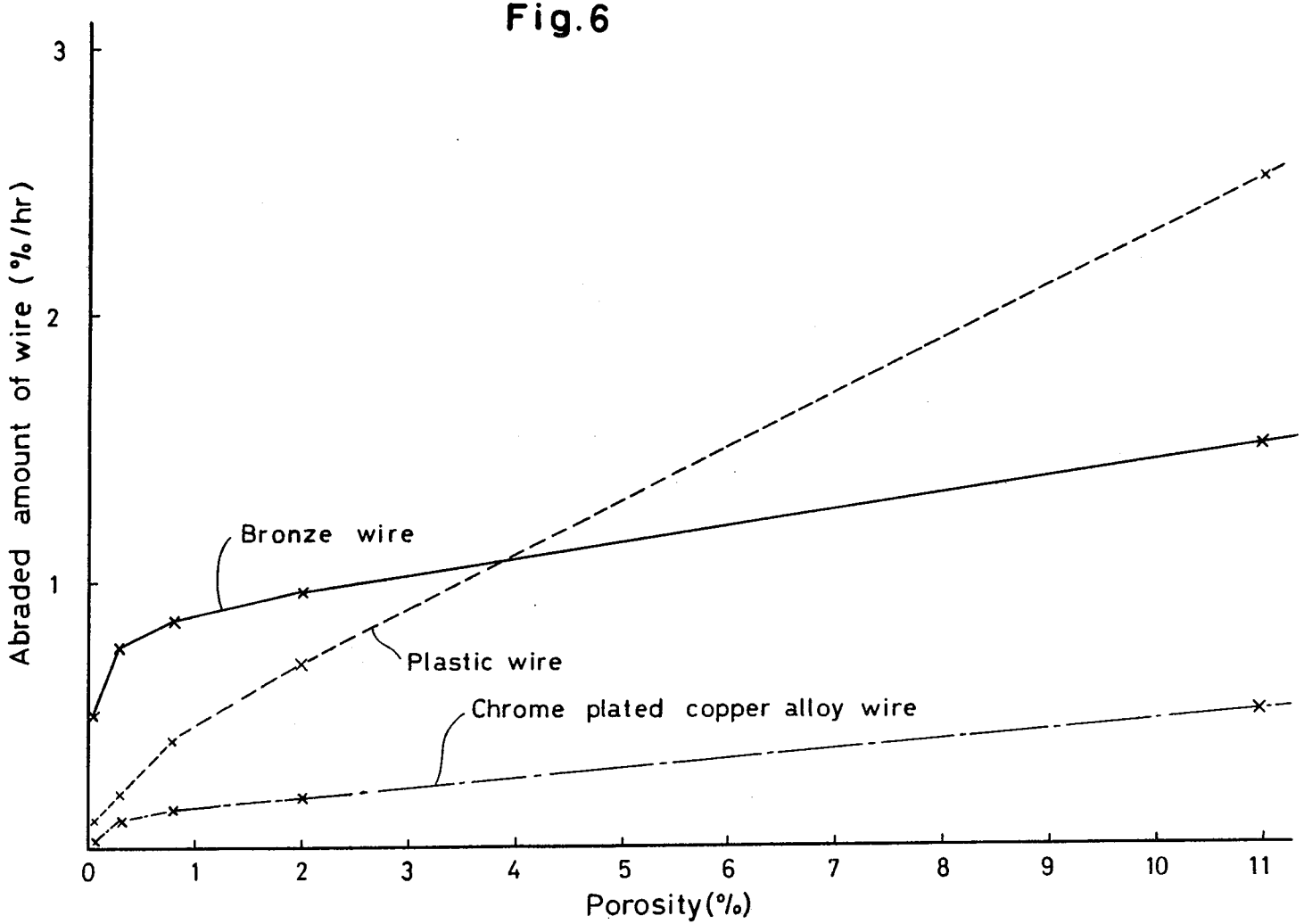
FIG. 6 is a graphical representation showing the correlation between the porosity of the supporting members of the present invention and the abrasion rate of the screens.

Reference to FIG. 6 shows the relationship between the porosity of the supporting members and the rate of abrasion. It can be seen that when the porosity of the sintered silicon nitride body of the supporting member is less than about 0.8%, the abrasion of all of the types of wires tested was significantly reduced.

A silicon nitride body having a porosity of less than 0.8% can be fabricated as follows. A formed body of silicon nitride of the composition described above is preformed together with a sintering assistant and a binder such as are known in the art. The body is then sintered in a nitrogen atmosphere at a constant temperature of approximately 1500 degrees C. Different porosities may be obtained by varying the sintering time. For example, one hour of sintering will result in a porosity of about 0.8%; two hours, about 0.3%; and five hours, about 0.05%.

Prior art methods of fabrication employed a reaction bond sintering method. Accordingly, the silicon nitride body was high in porosity due to $CO_2$ gas production. The resulting porosity was 10–30%. It is believed that porosity of less than 0.8% was never achieved.

The porosity of the silicon nitride bodies thus produced is tested as follows. The sample is dried for approximately one hour in a drying apparatus at a controlled temperature of 105–120 degrees C. Thereafter, the sample is placed in a desiccator and cooled to room temperature. The weight $W_1$ of the dried sample is determined. Next, the sample is boiled for about two hours in distilled water and then cooled to room temperature. The weight $W_2$ of the sample in the water is then measured with the sample left suspended in the water by a thin wire. Finally, the water left on the surface of the sample is wiped off with wet gauze and the weight $W_3$ of the water saturated sample is measured. The porosity is calculated according to the following equation:

$$\text{Porosity} = \frac{W_3 - W_1}{W_3 - W_2} \times 100\ (\%)$$

In addition to the above, using the same tester, the degree of the influence of the surface roughness of the roller made of a sintered body consisting essentially of silicon nitride upon the abrasion of the screen has been studied. As the result, the following facts have been realized, as seen from FIG. 5:

(I) With the lapse of time the surface roughness becomes progressively smaller, displaying a practically stable roughness.

(II) The above (I) results in the reduction of the abraded amount of the screen, thereby securing a practically stable value.

(III) Although there is some difference, more or less depending on the variation in the type of material, it is desirable for the surface roughness of the roller 42 to achieve the above (I), that is under $4\mu$.

Figure 1A:
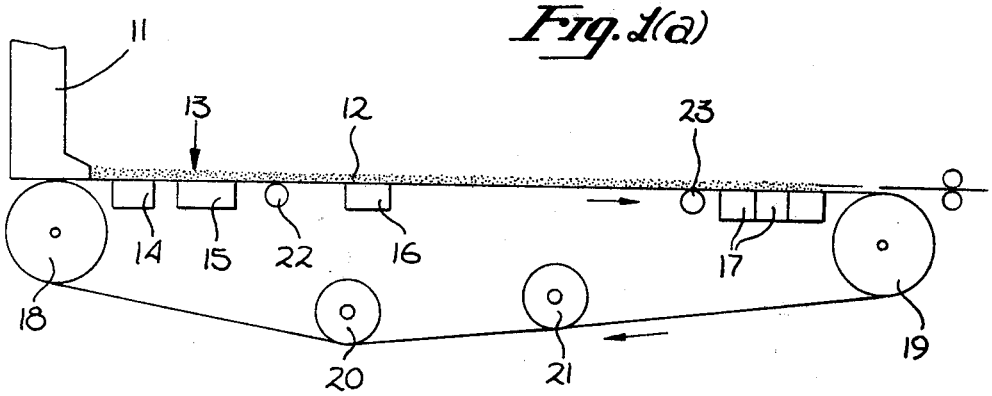
FIGS. 1(*a*) and (*b*) are schematic drawings of paper machines to which the members according to the present invention are applied.
Figure 1B:
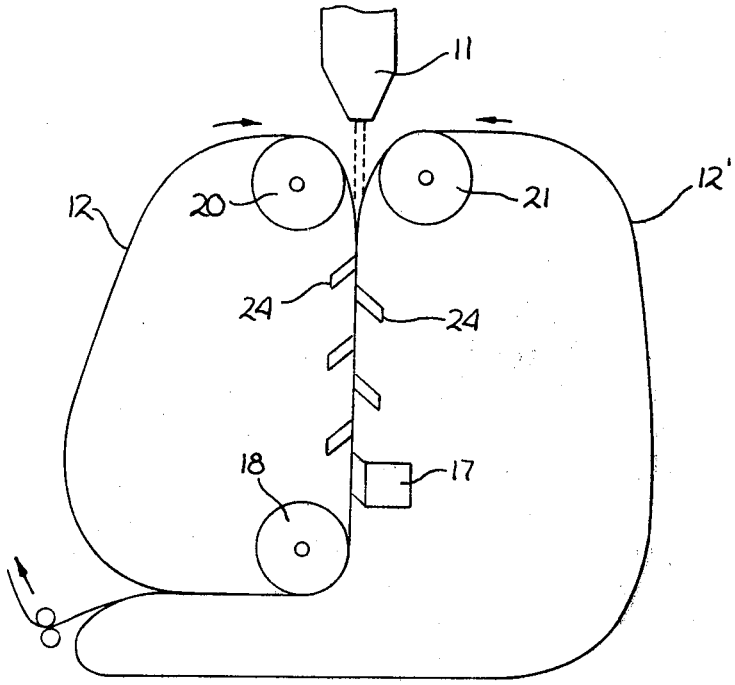
Figure 2:
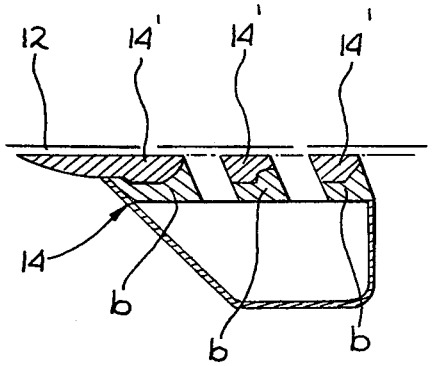
FIG. 2 is a longitudinal sectional view showing an example where the member according to the present invention is applied to a forming board.

There will now be described an example wherein the sintered body of silicon nitride according to the present invention has been applied to a twin wire-type paper machine shown in FIG. 1(B).

As seen in this figure, paper pulp coming down from the head box 11 first is caught between the two running screens 12, 12', then is dehydrated by the action of the supporting members 24 being so designed as to compress the respective screens 12, 12' alternatively from both sides, and after that the dehydrating operation is furthered by the suction box 17. In this case, the paper machine is operated under the conditions that the running speed of the screen 12 is 700 m/min, the material of the screen 12 is bronze, that of the screen 12' is plastic, and the tension applied to each screen is 4 kg/cm. In this there was actually produced paper of fine quality (70 $g/m^2$).

In this connection, we used tentatively the sintered body consisting essentially of silicon nitride in the capacity of the supporting member 24 which compressed the screen 12 made of bronze at a position nearest the head box 11 (however, at the other end ultra-macromolecular polyethylene was used). The useful life of the bronze screen 12 was seven (7) days where conventional supporting members made of alumina ceramic were used. Contrary to this, we could obtain by the adoption of the above-mentioned new silicon nitride member the better result that the durability of the bronze screen was lengthened to nine (9) days.

It is now evident from the above description that the present invention has many excellent advantages; that according to it the life of the papermaking screen becomes longer without being appreciably abraded irrespective of the quality of material; that it is possible to supply paper of fine quality at low cost and stably for a long time, and so on, by using a sintered body consisting essentially of silicon nitride for a supporting member of the screen in paper machines in contrast to conventional ones made of alumina ceramic.

I claim:

1. In a paper making machine having a continuous moving screen, the improvement comprising one or more supporting members for partially supporting said screen, each said supporting member comprising a sintered body consisting essentially of silicon nitride having a porosity of approximately 0.8 percent or less.

2. A machine according to claim 1 wherein at least one of said supporting members is affixed to a forming board so as to form an interface between said forming board and said screen.

3. A machine according to claim 1 wherein at least one of said supporting members is affixed to a deflector so as to form an interface between said deflector and said screen.

4. A machine according to claim 1 wherein at least one of said supporting members is affixed to a foil so as to form an interface between said foil and said screen.

5. A machine according to claim 1 wherein said paper making machine is a twin wire type and further wherein said supporting members are disposed alternatively on each side of a pair of parallel papermaking screens.

6. A machine according to claim 2 wherein said supporting member affixed to said forming board supports said papermaking section directly and contiguously.

7. A papermaking machine comprising a papermaking screen and a supporting member for said papermaking screen, said supporting member made of a sintered body consisting essentially of silicon nitride having a porosity of approximately 0.8% or less.

8. A papermaking machine as in claim 7 wherein said papermaking machine is of a long-screen type, and said supporting member is affixed to a forming board, a deflector, or a foil, or any combination thereof such that said member serves as an interface between said forming board, deflector or foil and said screen.

9. A papermaking machine as set forth in claim 8 wherein said supporting member affixed to said forming board supports said papermaking screen directly and contiguously.

10. A papermaking machine as set forth in claim 7 wherein said papermaking machine is a twin wire type and said supporting member is so disposed as to be able to compress a pair of papermaking screens.

* * * * *